United States Patent [19]

Game

[11] Patent Number: 4,765,621

[45] Date of Patent: Aug. 23, 1988

[54] TENNIS RACQUET

[76] Inventor: Francois Game, 31, avenue de la République, 75011 Paris, France

[21] Appl. No.: 888,056

[22] Filed: Jul. 22, 1986

[30] Foreign Application Priority Data

Jul. 23, 1985 [FR] France ..... 85 11214
Dec. 10, 1985 [FR] France ..... 85 18270

[51] Int. Cl.[4] ..... A63B 51/12
[52] U.S. Cl. ..... 273/73 E; 273/73 D
[58] Field of Search ..... 273/73 R, 73 C, 73 D, 273/73 E, 73 L, 26 A; 267/73, 74

[56] References Cited

U.S. PATENT DOCUMENTS

| | | | |
|---|---|---|---|
| 1,690,957 | 11/1928 | Tommins | 267/74 |
| 1,912,942 | 6/1933 | Kleinman | 273/73 E |
| 2,089,118 | 8/1937 | Fritsch | 273/73 E |
| 2,145,785 | 1/1939 | Aubert | 273/73 E |
| 3,751,083 | 8/1973 | Jacobson et al. . | |
| 4,057,249 | 11/1977 | Reedhead et al. | 273/73 E |
| 4,489,941 | 12/1984 | Shreh | 273/26 A |
| 4,613,138 | 9/1986 | Haythornwaite | 273/73 E |

FOREIGN PATENT DOCUMENTS

| | | |
|---|---|---|
| 784057 | 1/1935 | France . |
| 2300584 | 2/1975 | France . |
| 22409 | 6/1930 | Netherlands . |
| 380915 | 10/1932 | United Kingdom . |
| 2029241 | 9/1978 | United Kingdom . |

*Primary Examiner*—Anton O. Oechsle
*Assistant Examiner*—William E. Stoll
*Attorney, Agent, or Firm*—Lowe, Price, LeBlanc, Becker & Shur

[57] ABSTRACT

The present invention relates to a tennis racquet in which the stringing is at least partially constituted by a single string which passes around rollers disposed in the frame and of which at least one end is fastened to a tensioning device, arranged in the racquet handle, the tensioning device comprising at least one spring connected to the end of the string and an adjusting device for varying the tension imparted by the spring on the string, the adjusting device including a knurled maneuvring knob rotatably mounted at the end of the racquet handle and retained in place by the effort exerted by the spring, the knob and the end of the handle presenting complementary interfitting shapes which prevent rotation.

9 Claims, 4 Drawing Sheets

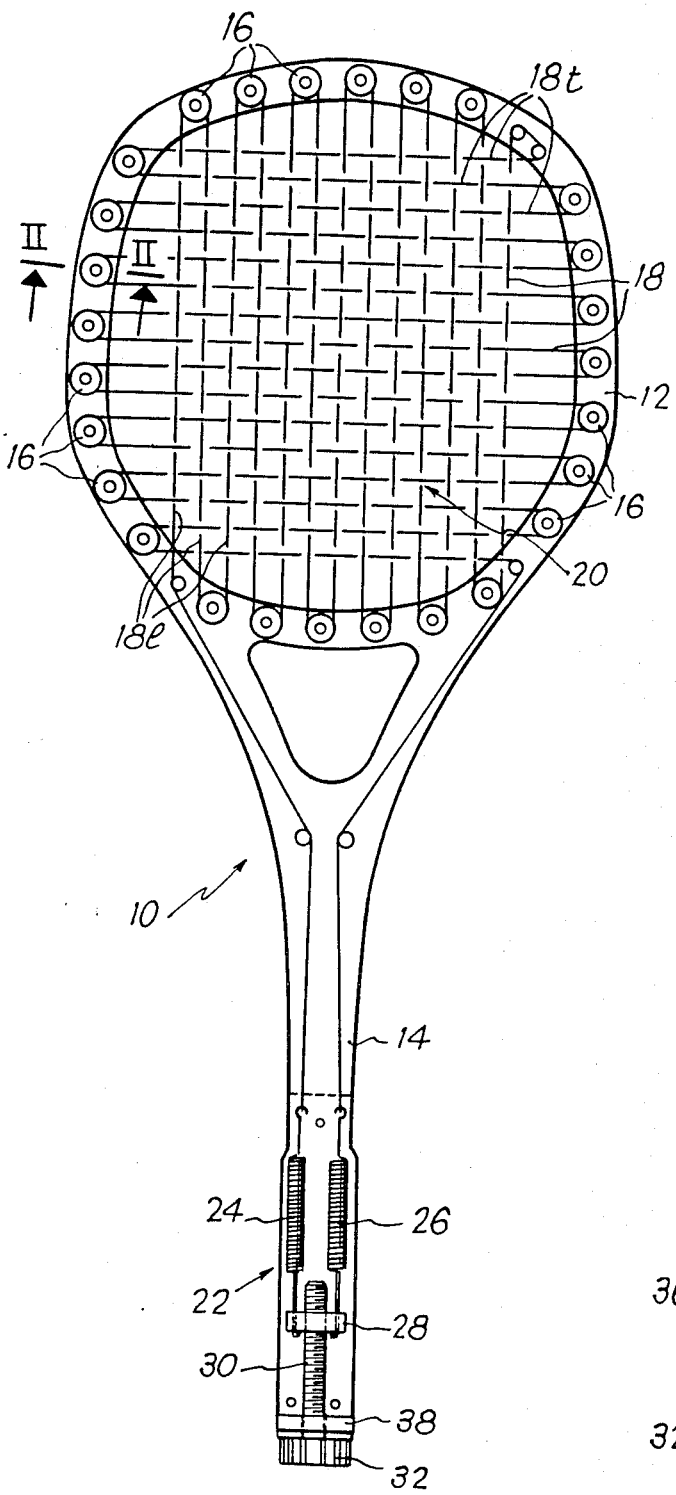
Fig. 1
Fig. 1b
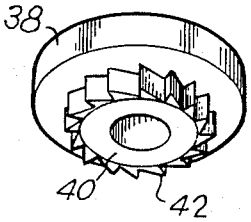
Fig. 1a
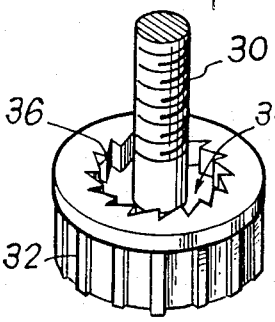

TENNIS RACQUET

FIELD OF THE INVENTION

The present invention relates generally to sports racquets and, more particularly, to tennis recquets provided with stringing having a tension adjustment.

BACKGROUND OF THE INVENTION

Traditional tennis racquets have fixed strings which have no flexibility other than that resulting from their natural elasticity. As the strings are fixed, the initial tension of the strings is also fixed.

Various factors influence this tension, such as in particular the ambient temperature and hygrometry, or the duration and force of the game and, as a general rule, the tension decreases although it would be desirable to maintain it as constant as possible.

Therefore, it is desirable to render this tension adjustable to enable the players to modulate their game depending on that of their opponents. In one known design of racquet, the string tension is adjusted by means of a screw and nut device housed in the racquet handle and fastened to several longitudinal strings of the head. This arrangement presents two limits: on the one hand, only a few longitudinal strings close to the centre of the head can have their tension adjusted, and, on the other hand, the tension is still likely to vary as a function of the outside factors, with the result that a readjustment is frequently necessary.

Patent NL No. 22 409 discloses a rudimentary tensioning device employing a compressed spring. A tool must be used for driving the adjusting nut and it is observed that the range of adjustment is fairly narrow since the turns of the spring are virtually contiguous. Finally, no means for blocking the nut are provided, and it therefore is likely that the nut may become loose.

SUMMARY OF THE INVENTION

It is therefore an object of the present invention to provide a racquet, e.g., a tennis racquet, in which the stringing is at least partially constituted by a single string which passes around rollers disposed in the frame and of which at least one end is fastened to a tensioning device, arranged in the racquet handle, characterized in that said tensioning device comprises at least one spring connected to said end of the string and an adjusting device for varying the tension imparted by said spring on said string, said adjusting device comprising a knurled manoeuvring knob rotatably mounted at the end of the racquet handle and applied against this end under the effort exerted by said spring, the knob and the end of the handle presenting complementary interfitting shapes which prevent rotation.

BRIEF DESCRIPTION OF THE DRAWING

The invention will be more readily understood on reading the following description with reference to the accompanying drawings, in which:

FIG. 1 is a plan view of a first embodiment of a racquet according to the present invention where the upper part of the frame and of the handle has been eliminated in order to render the drawing clearer.

FIGS. 1*a* and 1*b* are detailed views in perspective illustrating the complementary shapes of the knurled knob and of the end of the handle.

DETAILED DESCRIPTION OF THE PREFERRED EMBODIMENTS

Figure 2:
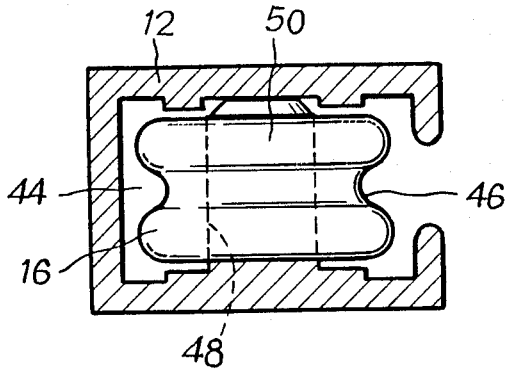
FIG. 2 is a view in section taken along line II in FIG. 1.

Referring now to the drawings, FIG. 1 shows the tennis racquet according to the invention generally designated by reference 10, which comprises a closed frame 12 of substantially oval shape and a handle 14 fast with the frame.

Guide rollers 16 are housed in the frame over the whole periphery thereof and a stringing 18 is stretched through the frame 12, passing successively around the rollers 16 so as to constitute a conventional head 20 formed by longitudinal portions 181 and transverse portions 18*t* which intersect one another successively above and below.

In this embodiment, the stringing 18 is formed by a single string of which the two ends extend in the handle 14 and are fastened to a tensioning device 22.

The tensioning device comprises two springs 24 and 26, each fastened at one end to the respective ends of the string 18 and at the other end to a slide 28 which may be displaced inside the handle in the longitduinal direction with the aid of a threaded rod 30 which is engaged in a tapped hole at the center of the slide.

The threaded rod is connected, on the handle end side, with a knurled manoeuvring knob 32 which is maintained firmly applied against the end of the handle by the tension of the springs 24 and 26. The knurled knob 32 is sufficiently large to be easily rotated by hand at any moment desired by the player, including during a match.

Due to the assembly of the stringing on the guide rollers 16, any addition or reduction in tension is virtually instantaneously distributed uniformly over the entire stringing.

The knurled knob 32 and the contacting end of the handle present complementary interfitting shapes intended to prevent unintentional rotation of the knurled knob.

As illustrated in FIGS. 1*a* and 1*b*, the knurled knob 32 presents a recess 34 surrounded by a ring (not numbered) with internal radial teeth 36. The racquet handle terminates in an endpiece 38, fast with the handle and presenting a complementary shape in relief 40 surrounded by outer radial teeth 42.

According to different variations, the teeth 36 and 42 may have symmetrical slopes or asymmetrical slopes so as to allow unidirectional rotation, in the sense of increasing the tension of the springs, by the user making a reasonable effort corresponding to the effort of deformation of the teeth 36 and 42.

The effort necessary for rotating the knurled knob in the direction for reducing the tension of the springs will preferably be higher. If trials justify this, the teeth may be made of virtually undeformable material, in which case a pull greater than the effort applied by the springs must initially be exerted on the knob in order to separate the two sets of teeth, i.e., 36 and 42, axially to allow rotation of the knob in one direction and/or in the other.

As illustrated in FIG. 2, the rollers 46 are disposed in recesses 44 made in the thickness of the racquet frame. Each of rollers 46 is made of an appropriate material taking into account the efforts coming into play and comprises a circumferential groove 46 for receiving the string.

These rollers 46 each comprise a central bore 48 engaged on a pin 50 which, depending on the applications, may be integral with the frame itself, the latter advantageously being made in two superposed parts glued or welded one to the other for convenience of assembly, or in the form of a separate part made of appropriate material.

Figure 3:
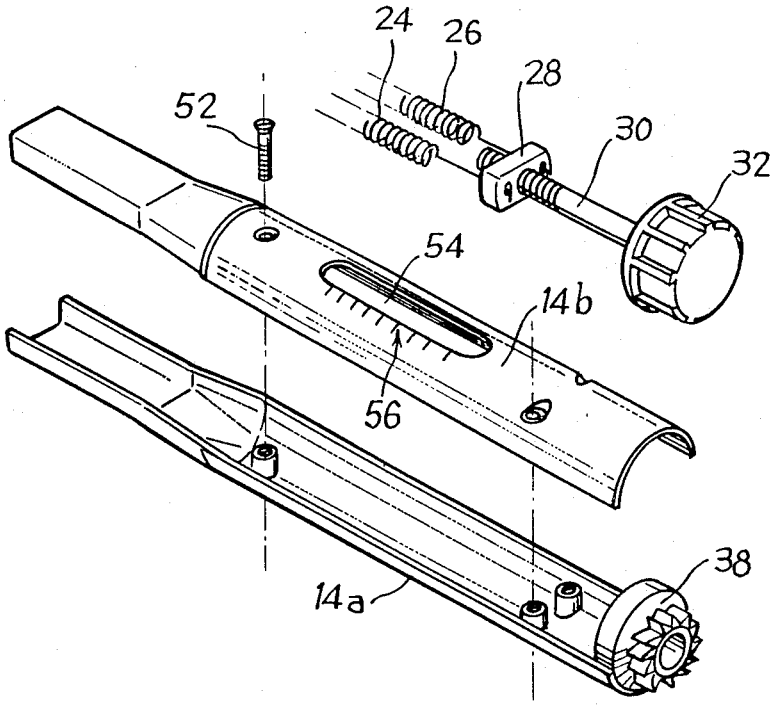
FIG. 3 is an exploded view in perspective illustrating the assembly of the tensioning device and the handle.

FIG. 3 illustrates a practical embodiment of the handle composed of two superposed generally semi-cylindrical shells **14*a*, 14*b* assembled with the aid of screws 52**, allowing easy access to the tensioning device particularly when the stringing of the racquet is replaced.

One of the shells of the handle, e.g., **14*b* in FIG. 3, comprises a longitudinal slot 54 through which the position of the slide 28 may be visually noted. A graduation 56 along the slot 54** directly indicates the tension of the stringing.

The racquet which has just been described may be the subject of numerous embodiments of which some will now be described. Details which have not been very specifically described will be understood by persons skilled in the art, such as in particular the number and arrangement of the guide rollers, the inherent characteristics of the springs (stiffness/extension) or the replacement by a single spring working in extension or in compression, depending on the type of racquet and level of play being considered.

Figure 4:
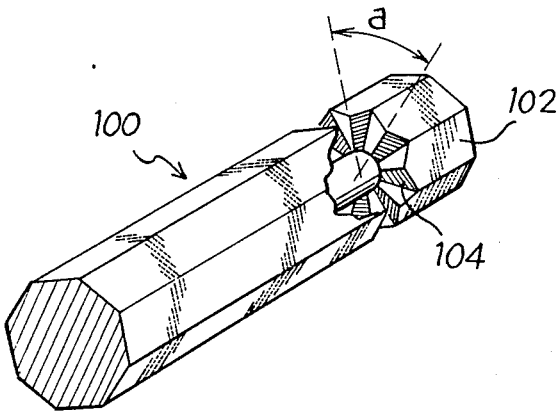
FIG. 4 is a schematic view similar to FIGS. 1*a*, 1*b* illustrating variant complementary shapes of the knurled knob and the handle.

Referring to FIG. 4, the racquet handle designated by reference 100 and the knurled manoeuvring knob 102 of the tensioning device, accommodated inside the handle and not shown for reasons of clarity, both comprise complementary radial grooves 104 distributed in a regular angular pitch a and formed by successive projections and depressions.

In this embodiment, when the springs of the tensioning device are under tension, the grooves of the knurled knob engage positively in the grooves of the handle and prevent any accidental rotation of the knurled knob and release of the tension which might result therefrom. However, the user may, by making a reasonable effort, rotate the knurled knob in one direction or the other, in order to vary the tension of the springs.

An angular pitch of the grooves will advantageously be chosen such that the rotation of the knurled knob over a pitch modifies the tension of the springs by a quantified value. For example, the jump from one groove to the following may correspond to a variation in tension of the springs of 500 gf. Knowing the initial tension of the stringing, the player therefore knows at any moment the resulting tension by simply counting the number of pitches of rotation of the knurled knob.

Figure 5A:
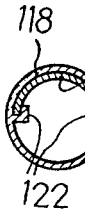
FIGS. 5*a* and 5*b* are sections of FIG. 5 taken along lines Va and Vb respectively.
Figure 5:
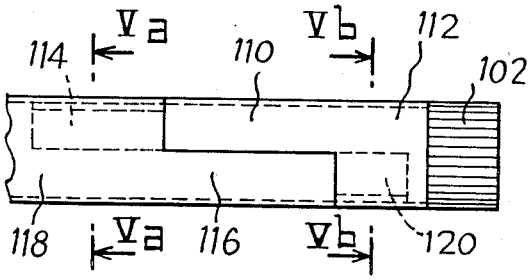
FIG. 5 is a side view illustrating another embodiment of the handle.
Figure 5B:
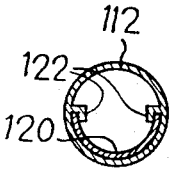

The assembly of the handle as a dismountable part, as illustrated in FIG. 5 and in sections **5*a*, 5*b*** thereof, is intended to facilitate the operations of stringing of the racquet.

To this end, the handle comprises a removable part 110 of substantially semi-cylindrical shape, terminating at one end in a whole endpiece 112 on which the knurled knob 102 for manoeuvring the tensioning device is fixed and at the other end by a semi-cylindrical fitting tongue 114.

The handle also comprises a fixed part 116 of semi-cylindrical shape also connected at one end in extension of the frame 118 of the racquet, and comprising at its other end a fitting tongue 120.

Each of the fixed and removable parts of the handle comprises a fitting housing adapted to receive the corresponding fitting tongue of the other part. As illustrated in FIGS. **5*a*, 5*b*, these fitting housings comprise inner longitudinal ribs 122 forming slideways for the edges of the fitting tongues 114, 120**.

The removable part 110 bears the knurled manoeuvring knob 102 as well as the whole of the tensioning device. Consequently, when this part is dismantled, there is easy access to all the elements of the tensioning device in order to make adjustments where necessary, and to proceed with hooking the strings on the springs during initial stringing or subsequent restringing.

This improvement is, of course, not limited to the embodiment described and shown, but extends to any embodiment in which part of the handle is removable and mounted with telescopic fit on the rest of the handle and racquet, the removable part bearing all the tensioning devices.

Figure 6:
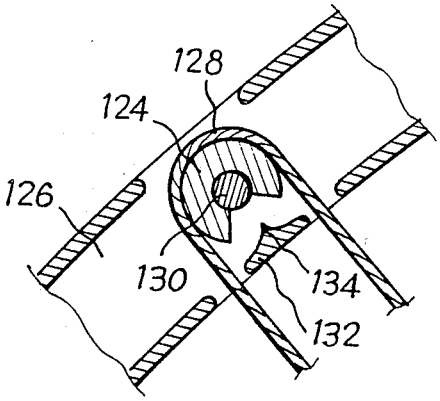
FIG. 6 is a view in detail illustrating a variant embodiment of the guide rollers of the head.

FIG. 6 illustrates an embodiment of this invention, with the rollers 124 (having the form illustrated) distributed over the periphery of the frame 126 and around which is wound the string 128 of the head between two successive passages of the frame, in the form of half-rollers 124.

As illustrated, a half-roller 124 in this embodiment consists of a notched roller presenting a cut-out over a given angular sector, in this case close to 90°. This structure provides multiple advantages:

there is no need to position the rollers prior to assembly to the two semi-blanks of the frame. In fact, the frame is first constituted by joining the two blanks together, by welding, gluing or any other appropriate technique, then the half-rollers are engaged in the frame through the peripheral slots made opposite each roller pivot pin 130, and then engaged on their respective pins by snapping.

replacement of a half-roller 124 is rendered possible, which is not the case with whole rollers;

connecting studs 132 between the two frame blanks may be provided opposite the roller pins, these studs increasing the rigidity of the frame, with bearing stop fingers 134 limiting the rotation of the half-rollers to about 45° on either side of their average position.

It has been ascertained in practice that the rotation of the rollers about their pins is limited to some tens of degrees at the most, as a function of the range of tensions applied to the stringing, hence it is, in fact, not necessary to provide whole rollers.

Figure 7:
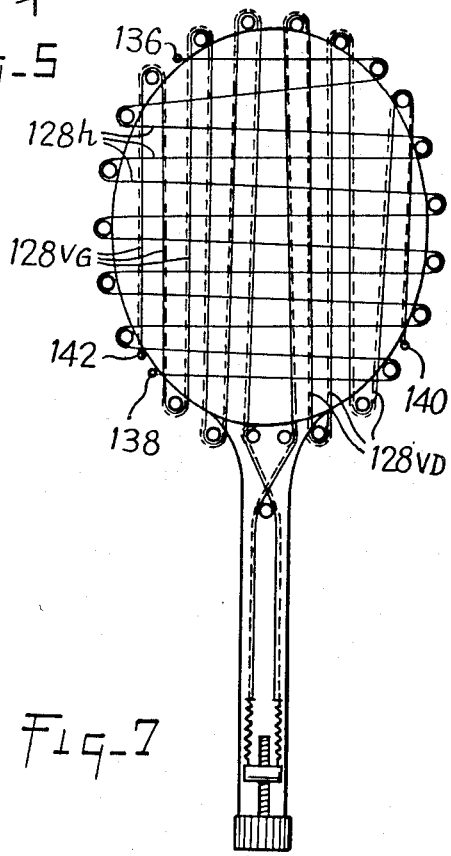
FIG. 7 schematically illustrates a racquet of which the stringing is constituted by a "horizontal" string with fixed tensioning, and by two "vertical" strings with variable tensioning.

FIG. 7 schematically shows a racquet of which the head comprises a "horizontal" string **128*h* starting from a first stop 136 and ending at a second stop 138** and forming all the horizontal crossings of the head. This string is placed in position under a fixed tension of 20 kgf for example.

The vertical stringing is divided into two strings viz. a "right-hand" string 128VD starting from a stop 140 and ending at one of the springs of the tensioning device after a certain number of vertical upward and downward passages constituting the right-hand vertical half of the head; and a "left-hand" string 128VG disposed substantially symmetrically from a stop 142 and ending at the other spring of the tensioning device.

It has, in fact, been ascertained that, in certain cases, the adjustment of the tension of the "horizontal" stringing is not strictly indispensable and this solution represents an advantageous compromise.

In such a case, horizontal and vertical strings of different nature will preferably be chosen, i.e., strings made of different materials, of different sections, and the like. This is symbolized in FIG. 7 by the different representation of the two strings (single continuous line for the horizontal stringing, double continuous and broken lines for the vertical stringings).

The tensioning of the vertical strings may be provided to concern only a limited number of strings on either side of a central line, the strings located outermost being mounted under fixed tension. This possibility may also be used for the horizontal strings (not shown in the figures).

Figure 8:
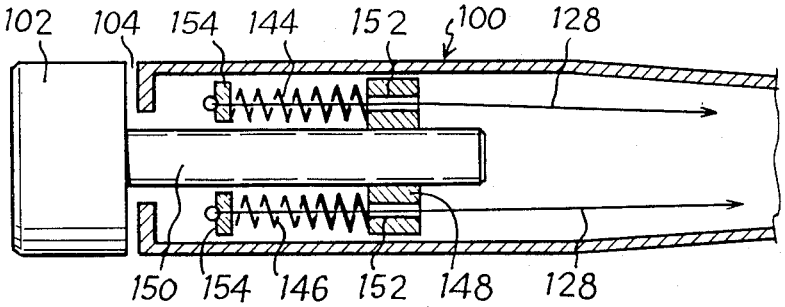
FIG. 8 illustrates a variant of the tensioning device where the springs are of variable characteristic.

In the variant tensioning device illustrated in FIG. 8, the springs 144, 146 are compression springs of variable characteristics. The springs are interposed between the mobile slide 148 along the central threaded rod 150 and the knurled manoeuvring knob. The two strings 128 coming from the head pass through the slide via two passages 152 then are fastened on plates 154 in abutment on the end of the springs.

These coil springs 44 are conveniently formed from a wire of increasing section. Consequently, the turns of wire of small section adjacent the abutment plates will have less stiffness than the turns of wire of large section adjacent the slide.

When the tension increases, by displacement of the slide with the aid of the knurled manoeuvring knob, the turns of low stiffness are firstly compressed in the form of contiguous turns, with the result that the effective stiffness of the spring varies progressively with progressive involvement of the turns of considerable stiffness.

Figure 9:
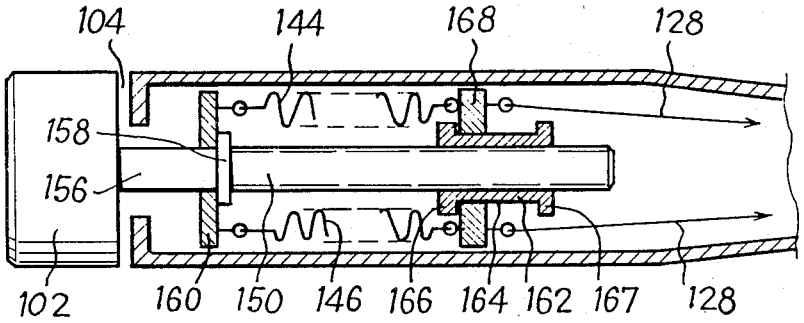
FIG. 9 illustrates another variant of the tensioning device establishing an initial tension of the spring which is different from the initial tension of the stringing.

In the embodiment of FIG. 9, the tensioning device makes it possible to establish an initial tension of the springs different from the initial tension of the stringing. In this embodiment, the threaded rod 150 fast with the knurled maneuvering knob 102 comprises a smooth shaft 156, in the vicinity of the knob, which terminates in a stop flange 158, and which bears a fastening plate 160 for the springs 144, 146, the plate therefore having a fixed position in abutment on the flange 158.

A tapped cylindrical bushing 162 is screwed on the threaded rod. This bushing comprises a smooth cylindrical body 164 and two beads 166, 167 in annular projection whose purpose is to limit the stroke of a slide 168 sliding along the body of the bushing.

The springs are connected to the slide by means of fasteners, whilst opposite fasteners on the slide receive the strings 128 coming from the head.

In this way, a given elongation of the springs is imposed by action on the knurled knob 102, corresponding for example to an effort of 45 kgf, between slide 168 and plate 160. The strings 128 are then fixed on their fasteners under a standard assembly tension, for example 20 kgf. Under static conditions, the slide 168 is therefore urged by springs by a force of $2\times45=90$ kgf and by the springs by a force of $2\times20=40$ kgf; it therefore remains applied on the annular bead 166 of the bushing 162 under a force of 50 kgf.

Under dynamic conditions, when a ball strikes the head, the deformation of the stringing provokes an increase in the tension of the stringing which is transmitted up to slide 168.

If the increase in tension does not exceed 25 kgf per string, the stringing plays on its own elasticity, without the springs intervening.

If the increase in tension exceeds 25 kgf per string, the slide 168 and the springs participate in absorbing the tension being experienced then by the stringing.

It is, of course, possible to modify at any moment the position of the bushing 162 along the threaded rod 150 by rotating the knurled knob 102. For example, if the bushing 162 is brought closer to the knob, the slide moves jointly with the bushing and the initial tension of the stringing (20 kg) increases as slide 168 moves. It will be noted that the tension of the springs decreases correlatively. In this way, from a given displacement of the bushing and of the slide, the tensions of the springs and of the stringings equalize and the slide will conserve a fixed position, even if the bushing continues to be moved. The springs and the other elements of the device will preferably be calculated so that, in this position, the tension of the strings is of the order of 30 kgf.

This arrangement makes it possible both to adjust the tension of the stringing, whilst adjusting the tension at which the springs intervene in the dynamic mode.

In fact, experiments show that this embodiment is the most advantageous.

Figure 10:
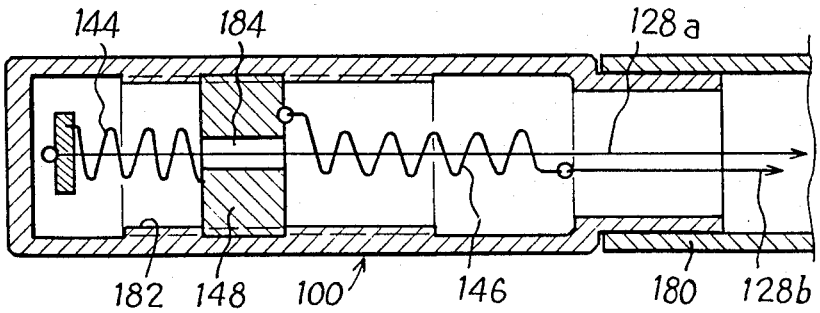
FIG. 10 illustrates a variant of the tensioning device where the springs are mounted "in-line".

In the variant embodiment illustrated in FIG. 10, the two springs 144, 146 are mounted "in-line" in the handle, this making it possible to reduce the dimensions in width of the tensioning device.

Here, the whole handle 100 is mounted to be rotatable on the frame of the racquet 180 and forms an internally threaded hollow housing 182 which receives an externally threaded slide 148. The slide comprises a central passage 184 traversed by one of the strings **128*a* which cooperates with a compression spring 144 housed between the slide and the end of the handle, whilst, on the other side of the slide is attached a traction spring 146 which cooperates with the other string 128*b***.

Rotation of the handle is translated by an axial displacement of the slide 148 and therefore by a correlative modification of the tension or compression of the springs 146, 144 and therefore of the tension of strings **128*a*, 128*b***.

The device therefore has very small transverse dimensions, which makes it possible to house it in handles of small diameter.

Insofar as the strings are here tensioned by springs of different nature (tension/compression), such a device may be associated with an arrangement as illustrated in FIG. 9 (two independent right-/left-hand vertical strings), this conferring a somewhat different behaviour on the two, i.e., right and left, halves of the head, or tensioning of the vertical stringing will be ensured with one, and of the horizontal stringing with the other.

All these variants may, of course, be combined with one another for specific purposes, certain being set aside if necessary as a function of the results effectively observed on racquets under trial.

Finally, it will be noted that all the embodiments of racquets described here present unprecedented dynamic characteristics due to the presence of the tensioning springs which store a certain energy then restore it when the ball is struck.

In addition, a substantial reduction in the vibrations transmitted via the handle to the player's arm, which are the cause of frequent physiological disorders, is noted.

The preceding embodiments are not intended to limit the scope of the apparatus of the present invention. Additional embodiments and advantages within the scope of the claimed invention will be apparent to one of ordinary skill in the art.

What is claimed is:

1. A strung tennis raquet having a frame comprising a head and a handle attached to said head, stringing extending across said head, said stringing comprising at least one tensioned string which passes around a plurality of rollers rotatably supported within said head with at least one end of said string fastened to a tensioning device positioned in the racquet handle, said tensioning device comprising at least one spring connected to said fastened end of the string and an adjusting device for varying the tension imparted by said spring on said spring, said adjusting device comprising a knurled knob rotatably mounted at the end of the racquet handle and applied against said end under a force exerted by said spring, the knob and the end of the handle presenting complementary interfitting shapes to prevent unintended relative rotation therebetween, and at least one of the rotatably disposed rollers for assembly of the stringing having the form of a sector extending over a predetermined angular span less than 360°.

2. The strung tennis racquet of claim 1, wherein:

said sectorial roller is mounted by snap-fitting into place in said frame.

3. The strung tennis racquet of claim 1, wherein:

the racquet frame comprises a stop finger disposed on said frame for cooperating with said sectorial roller for limiting the degree of rotation thereof.

4. A strung tennis raquet having a frame comprising a head and a handle attached to said head, stringing extending across said head, said stringing comprising at least one tensioned string which passes around a plurality of rollers rotatably supported within said head, with at least one end of said string fastened to means for tensioning string, positioned in the racquet handle, said tensioning means comprising at least one spring connected to said fastened end of the string and an adjusting device for varying the tension imparted by said spring on said string, said adjusting device comprising a knurled knob rotatably mounted at the end of the racquet handle and applied against said end under a force exerted by said spring, the knob and the end of the handle presenting complementary interfitting shapes to prevent unintended relative rotation therebetween, and the string comprises two vertical strings disposed to form the right- and left-hand halves of the racquet head respectively, said strings being independently tensioned initially by said tensioning means.

5. The strung tennis racquet of claim 4, wherein:

each of said two vertical strings is provided with tension by a separate spring, attached to a respective end thereof and to said adjusting device, said springs having stiffness related to the degree of deformation thereof.

6. A strung tennis raquet having a frame comprising a head and a handle attached to said head, stringing extending across said head, said stringing comprising at least one tensioned string which passes around a plurality of rollers rotatably supported within said head, with at least one end of said string fastened to a tensioning device positioned in the racquet handle, said tensioning device comprising at least one spring connected to said fastened end of the string and an adjusting device for varying the tension imparted by said spring on said string, said adjusting device comprising a knurled knob rotatably mounted at the end of the racquet handle and applied against said end under a force exerted by said spring, the knob and the end of the handle presenting complementary interfitting shapes to prevent unintended relative rotation therebetween, and a second spring disposed to coact in line with the first spring, such that one of the springs is in tension and the other spring is in compression when the stringing is tensioned.

7. A strung tennis raquet having a frame comprising a head and a handle attached to said head, stringing extending across said head, said stringing comprising at least one tensioned string which passes around a plurality of rollers rotatably supported within said head, with at least a first end of this string fastened to a tensioning device positioned in the racquet handle, said tensioning device comprising at least one spring connected to said fastened first end of the string and an adjusting device for varying the tension imparted by said spring on said string, said adjusting device comprising a knurled knob rotatably mounted at the end of the racquet handle and applied against said end under a force exerted by said spring, the knob and the end of the handle presenting complementary interfitting shapes to prevent unintended relative rotation therebetween, and means for establishing an initial tension of the spring which is different from the initial tension of the string tension provided by the spring.

8. The strung tennis racquet of claim 7, wherein:

said means for establishing an initial tension of the spring different from the initial tension of the string tensioned thereby comprises a shaft connected to be rotatable by the knurled knob and having a smooth portion adjacent thereto;

a fastening plate supported on said smooth portion of the shaft to slide freely thereon to a stop provided on the shaft, said fastening plate being attached to a first end of the spring;

a tapped bushing threaded onto a portion of the shaft adjacent a second end of the spring, said bushing comprising an externally smooth generally cylindrical surface and two beads defining a length thereof; and a slider element supported to freely slide on said length of cylindrical surface, said slider element being connected to said second end of the spring and to a second end of the string, whereby rotation of the knurled knob enables adjustment of the desired difference in initial tension between the spring and the string.

9. The strung tennis racquet of claim 8, further comprising:

an additional spring connected to act in parallel with the at least one spring between the fastening plate and the slider element.

* * * * *